United States Patent [19]

Stephenson et al.

[11] 4,000,548

[45] Jan. 4, 1977

[54] SEPARABLE FASTENER WITH PIN LATCH

[75] Inventors: Robert L. Stephenson, Sterling Heights; Jerome W. Schotthoefer, New Baltimore, both of Mich.

[73] Assignee: Allied Chemical Corporation, Morris Township, N.J.

[22] Filed: Mar. 4, 1976

[21] Appl. No.: 663,943

[52] U.S. Cl. ..... 24/230 AL; 24/230 AV

[51] Int. Cl.[2] ..... A44B 11/26

[58] Field of Search ... 24/230 AN, 230 AL, 230 A, 24/230 AV

[56] References Cited

UNITED STATES PATENTS

| | | | |
|---|---|---|---|
| 3,293,715 | 12/1966 | Wisniewski | 24/230 A |
| 3,789,492 | 2/1974 | Klink | 24/230 AL |

*Primary Examiner*—Bernard A. Gelak
*Attorney, Agent, or Firm*—John P. Kirby, Jr.

[57] ABSTRACT

A safety buckle and tongue in combination wherein pressure on the tongue release push button is employed at a mechanical advantage, hence the buckle is unlatched with a minimum of effort even under conditions of stress. A ferrule provides a continuous link between the members of the restraint system to be connected, providing great strength and reliability.

A pin, biased downwardly, latches the inserted tongue securely by entering an opening in the tongue. In inserting the tongue, an ejection member within the slot is forced back against its bias. When the pin is extracted from the tongue by the pressing of a push button, the tongue is ejected and the ejection member comes to rest directly beneath the pin, restraining it above the slot until displaced by the reinsertion of the tongue.

18 Claims, 6 Drawing Figures

SEPARABLE FASTENER WITH PIN LATCH

CROSS-REFERENCE TO RELATED APPLICATIONS

This application is related to co-filed applications, "Ferrule Buckle with Sliding Release Button", Robert L. Stephenson, and "Improved Ferrule Buckle", Per Olaf Weman,

BACKGROUND OF THE INVENTION

1. Field of the Invention

This invention relates to a buckle and tongue combination of the type used in automobiles, airplanes and other vehicles, for retaining an occupant in a seated position within the vehicle at a moment of rapid deceleration. With many of these the buckle is attached to the frame or body of the vehicle by a relatively short rigid or semi-rigid connector, and the cooperating tongue is attached to one or two flexible passenger restraints disposed over the lap, or the lap and chest of the user. In other passenger restraint systems, both tongue and buckle are attached to flexible restraints. Generally the tongue is inserted into the buckle and latched, thereby securing the restraining system about the passenger. Various means have been devised to release the latched tongue. Release of the tongue is effected by lifting the cover of the buckle or depressing a button on its upper surface. This action forces the latching member out of engagement with the tongue, permitting the tongue to be removed from the buckle.

2. Description of the Prior Art

A large number of such buckle and tongue combinations are found in the prior art, practically all of which incorporate a buckle having some type of latching means co-acting with the tongue. Many of these have an independent latching member within a cast metal or predominantly plastic housing, and frequently the connection between the release button or lever, and the latching member, is indirect.

It is an object of the present invention to provide a rugged and functional safety buckle and tongue combination which cannot be unlatched by the application of stress, yet a buckle wherein the tongue can be released by the application of a minimal effort by the user, even when the buckle is under stress.

It is a further object of this invention to provide a buckle wherein the strength of the connection between the tongue at one end and the attached passenger restraint at the other, is independent of the housing or the secondary components. In the buckle of this invention the tongue is not only latched, but locked to the ferrule, and the ferrule is fixedly attached to a passenger restraint such as a steel cable. The connection is both simple and reliable.

SUMMARY OF THE INVENTION

The present invention is directed to a positive-acting buckle and tongue combination. The basic structure is an elongated ferrule. By the term "ferrule" we mean an elongated metal member which constitutes the connecting link between the tongue at one end and the passenger restraint at the other.

The shape of the ferrule is not critical, but preferably the ferrule is cylindrical.

In the buckle of the present invention the tongue latches to the ferrule so that a direct connection is had between the tongue and the restraint attached to the ferrule. Preferably the components making up this direct connection, namely the tongue, the latch pin and the tongue release lever are fabricated of metal. The remaining components which include the housing, the sheath for the ferrule when this component is used, and the tongue ejector, may also be metal, but preferably they are fabricated of a polymeric material. The use of such materials for these components reduces the weight of the buckle without loss of strength for they are under substantially no strain or tension. They also contribute to the smooth action of the moving parts.

Briefly, the buckle and tongue in combination comprises, first, the ferrule having a passenger restraint fixed at one end, and a through slot at the other for engaging the tongue. An opening extends at least into the slot from the surface of the ferrule, said opening being perpendicular to the plane of the slot. Preferably this opening continues through the first, and well into the second arm of the ferrule. It may continue entirely through the two arms on each side of the slot, being an opening, preferably cylindrical, passing through the slotted portion of the ferrule and perpendicular to the slot.

A pin is slideably positioned in the opening, piston-like, and biased downwardly for engaging an opening in the tongue situated to accept the pin when said tongue is inserted into the slot. The means employed can be a first order lever, one leg comprising a push button, accessible through an opening in the housing; the other leg extending beyond the fulcrum, engaging the upper portion of the pin. With this arrangement, downward pressure on the push button end of the lever produces an upward movement of the engaged pin against its bias. When the fulcrum is closer to the point of engagement with the pin than with the push button, a mechanical advantage is obtained for raising or extracting the pin from the opening in the tongue.

There are several ways in which the lever may engage the pin. The end of the lever can be a bifurcation to lift the pin by acting beneath a head on the pin. A reduction in the circumference of the pin near the top can similarly provide a purchase for such a bifurcation. Alternately, the pin may be raised by the sloping surface of an inclined plane, hereafter referred to as a wedge. The pin can have at its upper end, projections on opposite sides extending toward the sides of the buckle. These projections contact the sloping surfaces of two wedges, one on each side of the pin, whereby pressure on a outwardly biased sliding push button to which the wedges are attached, raises the pin out of the slot in opposition to its bias. The projections referred to can be the ends of biasing springs inserted into the corresponding openings in the upper part of the pin to provide the downward bias. Decreasing the slope of the wedges increases the degree of mechanical advantage they provide for raising the pin.

A tongue ejection member is provided, having a flat portion for sliding reciprocating action within the slot of the ferrule, and biased outwardly to a stopping point directly below the pin.

In operation, when the tongue is inserted, it contacts the tongue ejector to force it back in opposition to its bias, freeing the pin to drop, in response to its bias, into the opening of the tongue, thereby securely latching it to the ferrule. When the pin is raised, the tongue ejection member slides forward in the slot in response to its bias, forcibly ejecting the tongue, and stopping directly beneath the raised pin, retaining it above the slot until the tongue is reinserted.

In one embodiment of our invention, the ferrule is enclosed in a cylindrical sheath which can be integrated with the front face of the buckle housing. Slotted openings correspond with the sides of the slot of the ferrule, allowing freedom of motion to the tongue ejector. An opening also coincides with that in the top of the ferrule for the pin. A fulcrum can either be provided on the top of the sheath, or outward extensions on the side, or openings for a shaft extending through the ferrule, can provide journals for legs extending from the lever, to thus provide the fulcrum.

A better understanding of the operation of the buckle and tongue in combination of the present invention may be had by reference to the accompanying drawings wherein like reference characters refer to like parts throughout the several views.

Figure 1:
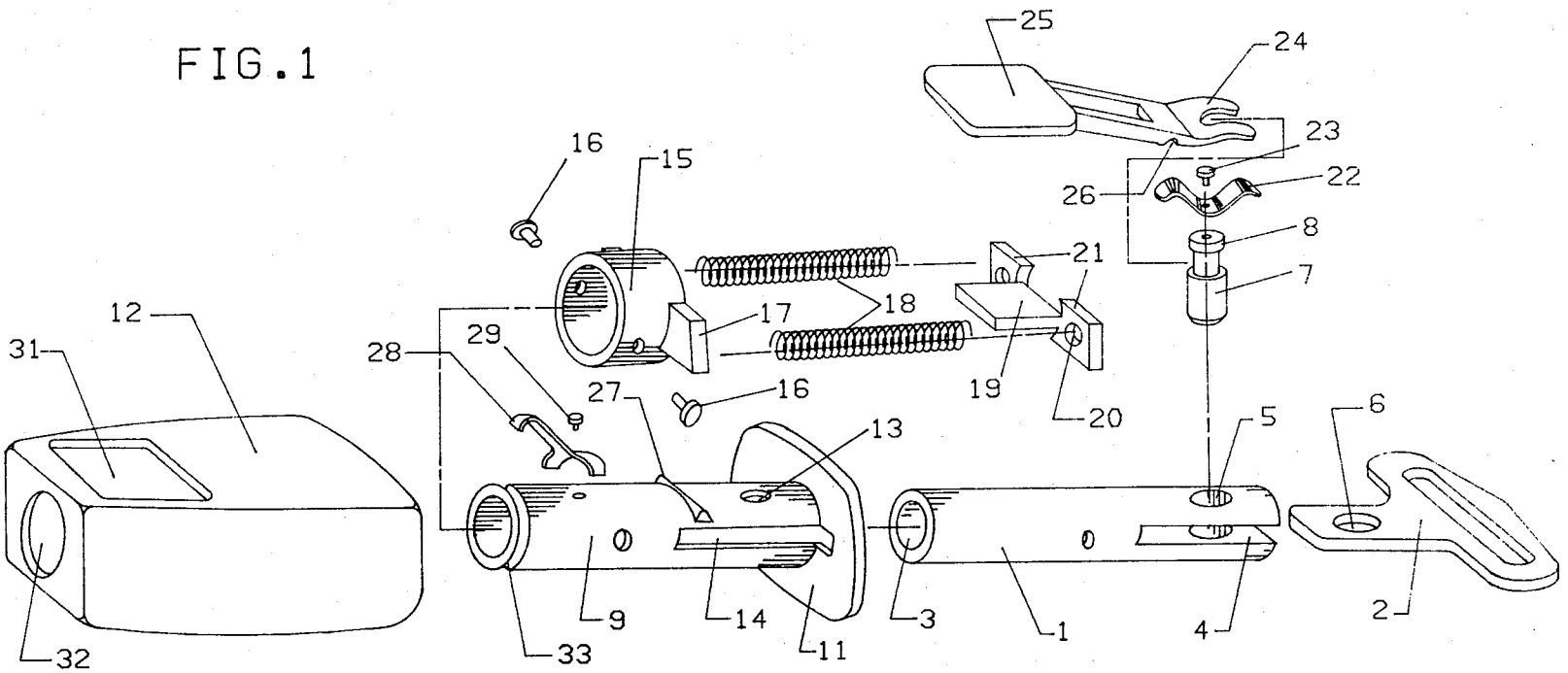
FIG. 1 is an exploded view of one embodiment of the seat buckle and tongue combination of the present invention.

A single trifurcated flat metal spring attached to the frame of the push button has been substituted for the two flat springs of FIG. 1.

Figure 4:
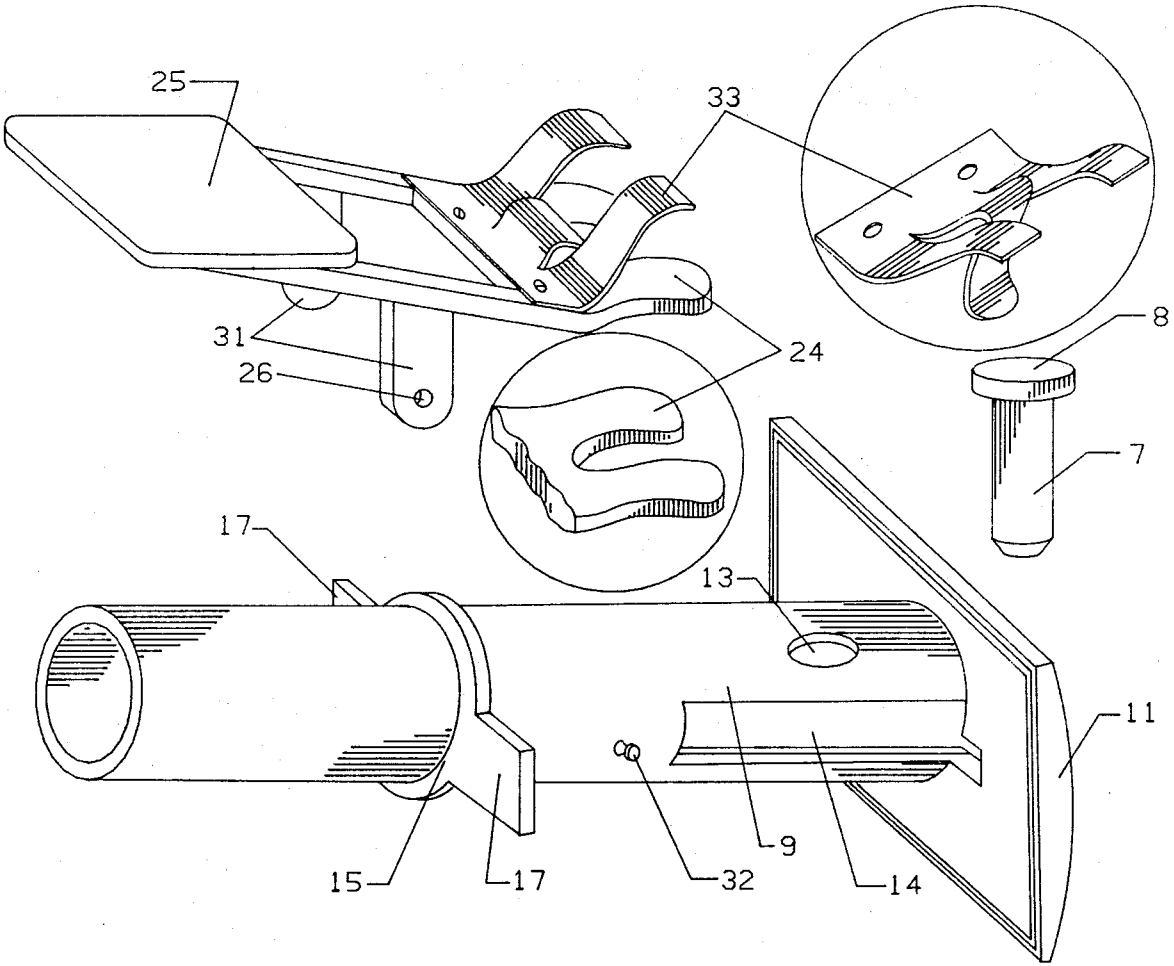
FIG. 4 is an enlarged perspective view of the biased push button, the pin and the sheath for enclosing the ferrule, of an embodiment differing slightly from that of FIG. 1. Here the push button pivots on projections at the side of the sheath rather than at a fulcrum on its top surface. These projections can be the ends of shafts extending part way, or all the way through the ferrule within.
Figure 5:
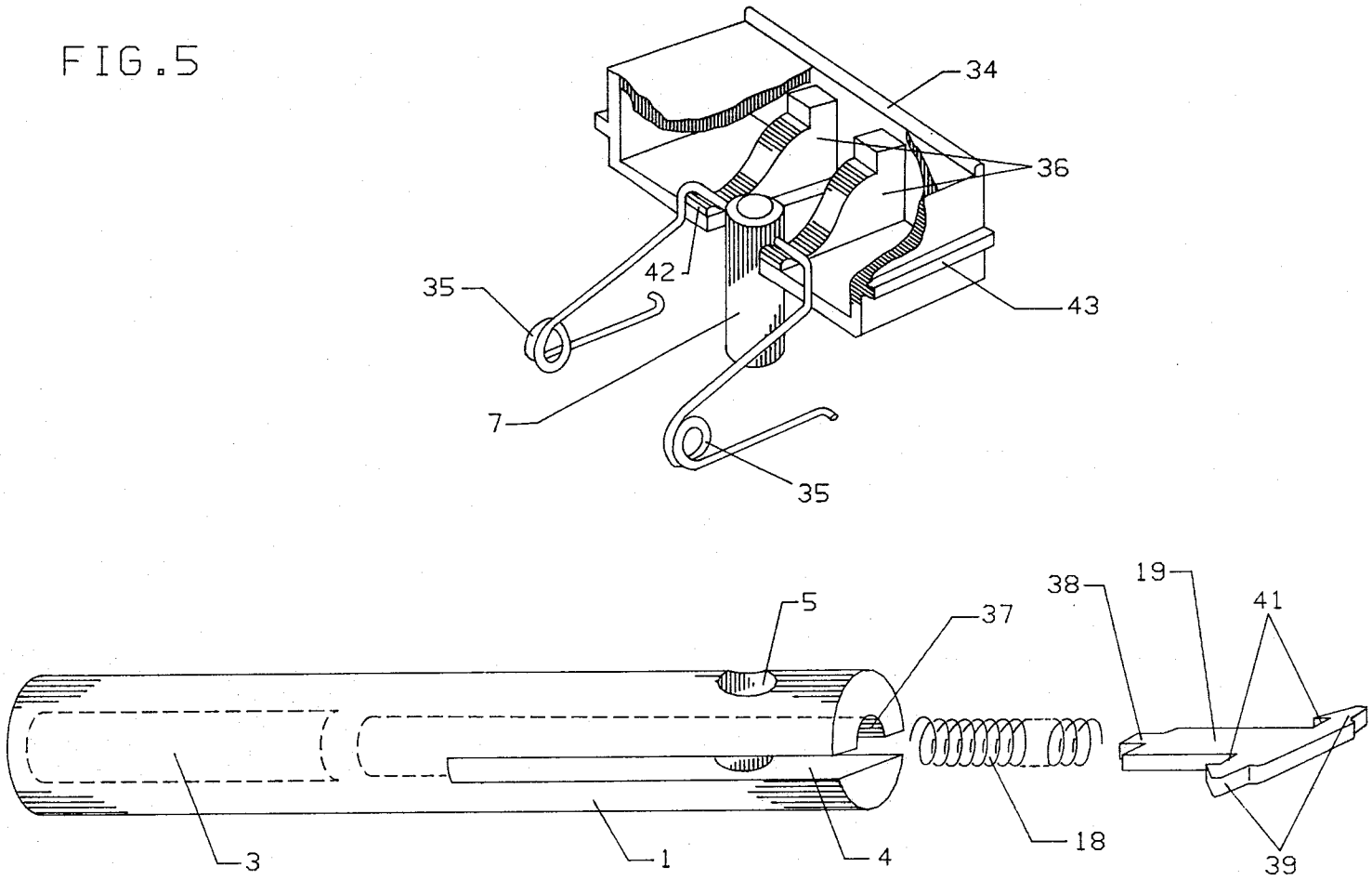

FIG. 5 is an enlarged perspective break-away view of a slide push button, a biased latching pin, a ferrule, a tongue ejector and a tongue ejector spring of still another embodiment of the seat buckle and tongue combination of the present invention. This embodiment differs only slightly from the buckle of FIG. 1. The pin, as before, is biased downwardly, but here the pin is lifted out of engagement with the tongue by two wedges with can be pressed under the upper part of the springs that bias the pin downwardly. A single coiled ejector spring which operates in a cylindrical longitudinal chamber, concentrically positioned within the ferrule, replaces the two external ejection springs used in the embodiments of FIGS. 1 and 4.

Figure 6:
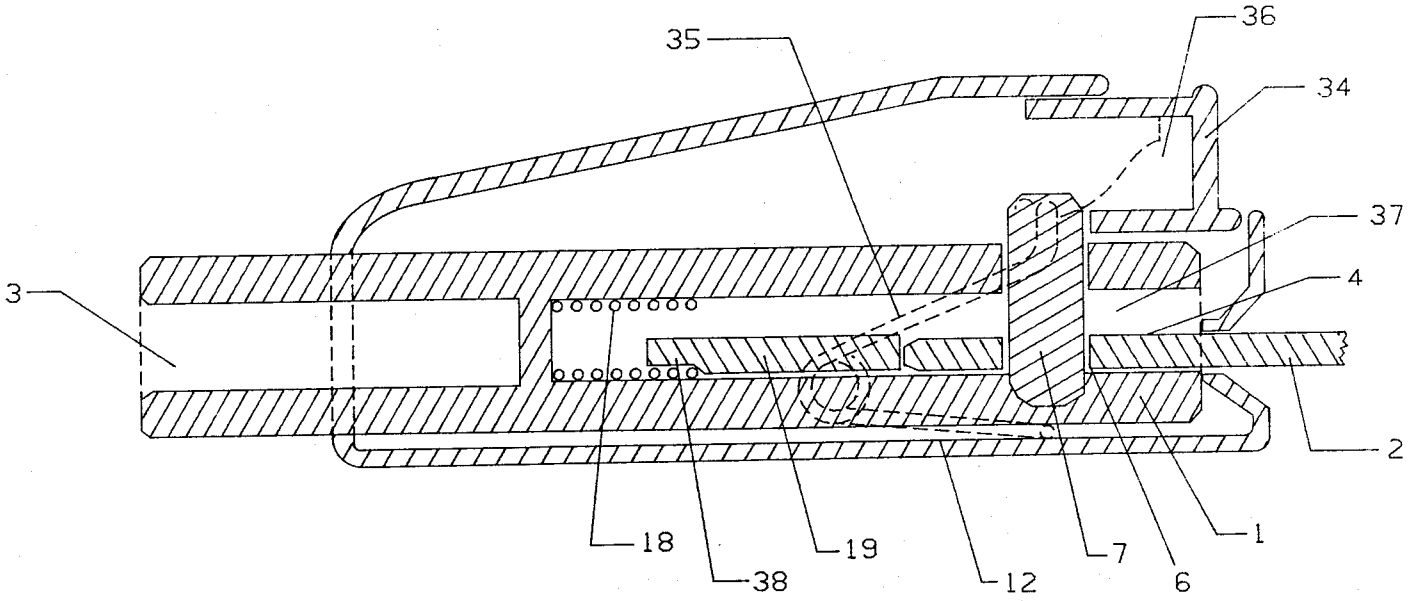

FIG. 6 is an enlarged cross-section in elevation of the assembled buckle of FIG. 5 within a housing. The tongue has been inserted and securely latched by the pin. All three embodiments are similar in that they have a ferrule with a through slot and a pin operating within a cylindrical opening perpendicular to the slot for engaging a corresponding opening in an inserted tongue. Also, in each case the pin is lifted by pressing a button, and the pin is retained in its unlatched position by the tongue ejector, after the tongue is ejected. In each embodiment the tongue ejector is slideably positioned in the slot, is biased outwardly, and is stressed for ejecting the tongue by the very act of inserting the tongue.

DETAILED DESCRIPTION OF THE PREFERRED EMBODIMENT

With reference to the six figures, our invention is directed to a safety seat buckle and tongue in combination comprising a ferrule 1 provided with means at its front end for engaging or disengaging a tongue 2, and at the other end, means for the fixed attachment of a seat belt or other restraint.

By the term "ferrule" we mean in this instance, a connecting member which forms the link between the tongue when engaged therein, and a cable, belt or other restraint which may be flexible, semi-rigid or rigid.

In the embodiments of the drawings, the ferrule 1, preferably fabricated of metal, receives tongue 2 at its front end, and is attached to a restraining cable or shaft, the receptacle for which is shown as 3.

In the front of the ferrule there is in the case of each of the three embodiments shown, a parallel sided through slot 4 which may be centered as in FIG. 1 or placed off-center as in FIGS. 5 and 6. The slot is sized to accept the forepart of tongue 2. A short distance from the front end of the ferrule there is a cylindrical opening 5 extending from either the upper or lower surface of the ferrule, substantially perpendicular to the surfaces of the slot and of the tongue when inserted. This cylindrical opening extends at least to the slot, and preferably extends beyond the slot into the substance of the ferrule. If desired, the opening may extend entirely through the ferrule.

Tongue 2 also has an opening 6 in its forward section, so positioned, that when the tongue is inserted into the slot, the opening in the tongue substantially coincides with the cylindrical opening 5 and therefore constitutes a port or continuation of that opening.

A cylindrical pin 7 is provided with sufficient clearance to easily move piston-like slideably through the cylindrical opening 7. The diameter of the upper portion of this pin may be reduced, leaving a head 8 as in FIGS. 1, 2 and 3. It may be uniformly cylindrical but having a head as in FIG. 4, or it may be uniformly cylindrical with openings near the top as in FIGS. 5 and 6. There are of course many other variations in the form of pin 7 which would equally as well provide the means for permitting it to be raised in the cylindrical opening 5. Furthermore, the shape of the cross section of the pin, the cylindrical opening through which it moves, and the opening in the tongue, is not critical. A pin having a square, oblong, or any other cross section would also be effective.

The ferrule may be enclosed in a sheath 9 as in FIGS. 1, 2, 3 and 4, or arranged without a sheath as in FIGS. 5 and 6. Where the sheath has been used as in the first four figures, we have shown this sheath 9 in combination with the forepart 11 of a housing 12, said forepart carrying the elongated opening which serves to guide the tongue 2 into the slot of the ferrule.

Referring now more particularly to FIG. 1, ferrule 1 slips into sheath 9 with the cylindrical opening of the ferrule coinciding with an opening 13 of the sheath, and slot 4 of the ferrule coinciding with elongated openings 14 of the sheath.

Spring supporting member 15 is pressed over sheath 9 and fixed thereto. This may be accomplished by a pin, screws or rivets 16. Extending arms 17 provide a support for ejection springs 18, and preferably these have cylindrical depressions or short projections to provide seats for the ends of springs 18.

Tongue ejector 19 is placed in slot 4 of the ferrule, with arms 21 extending beyond both the ferrule 1 and sheath 9. The slot 4 extends far enough to the rear to accommodate both the tongue ejector 19 and the fully inserted tongue 2, behind it. Arms 21 of the tongue ejector, as with those of the spring support member 15, preferably have shallow cylindrical indentations 20 for seating springs 18 which are now positioned between arms 17 and 21 to thus bias the tongue ejector 19 toward the front of the buckle. The forepart of the housing serves as the forward stop for the biased tongue ejector 19.

Flat spring 22 is attached to the top of pin 7 with rivet 23 or other means. The pin 7 is placed in cylindrical opening 5, and the bifurcated end 24 of the push button member 25 is slipped into that portion of the pin of reduced diameter. The fulcrum 26 of the push button member 25 is positioned over the raised pivot edge 27 of the sheath 9.

Saddle-shaped flat spring 28 is attached to the sheath with rivet 29 or other means, and serves to bias the push button 25 upward.

When the components are assembled in housing 12, push button 25 is accessible through opening 31 of the housing. In the embodiment shown in FIG. 1, opening 32 of the housing is engaged by recessed groove 33 of the sheath. A cable or other restraint can be permanently crimped into opening 5 of the ferrule.

Figure 2:
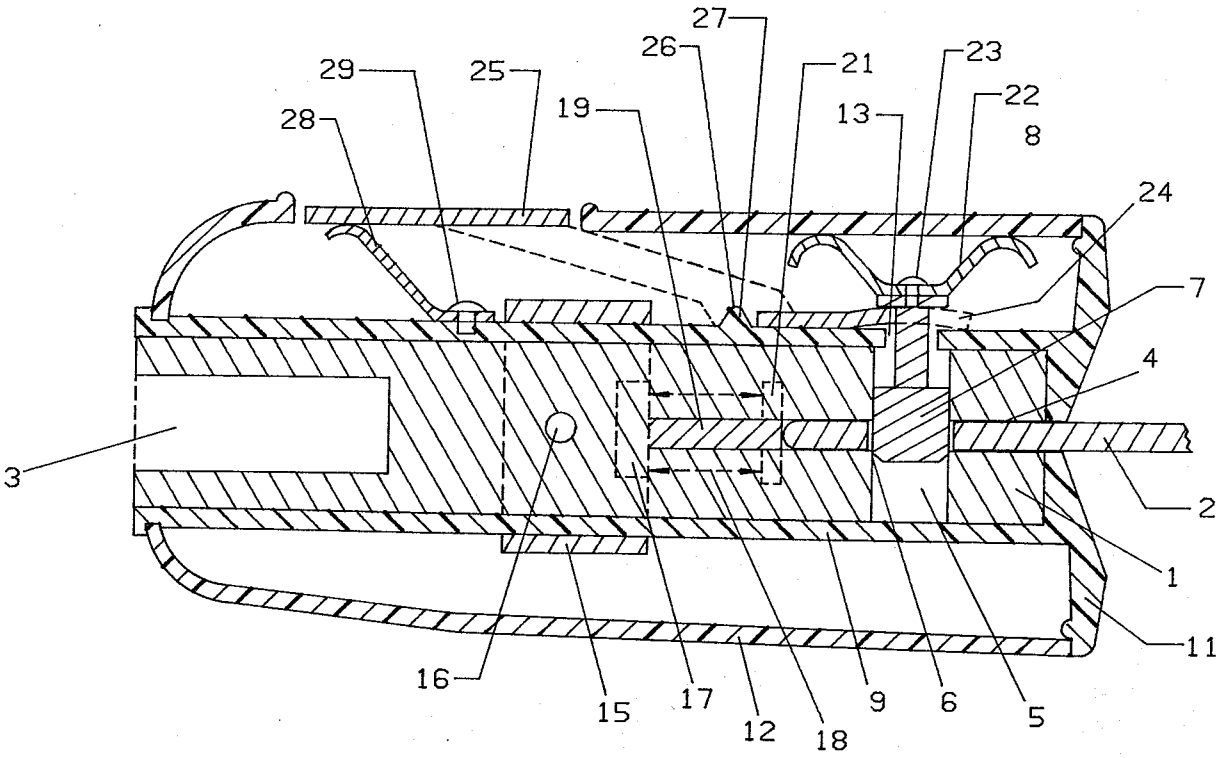
FIG. 2 is an enlarged cross section in elevation of the assembled buckle of FIG. 1 with tongue inserted and securely latched into position by a pin.
Figure 3:
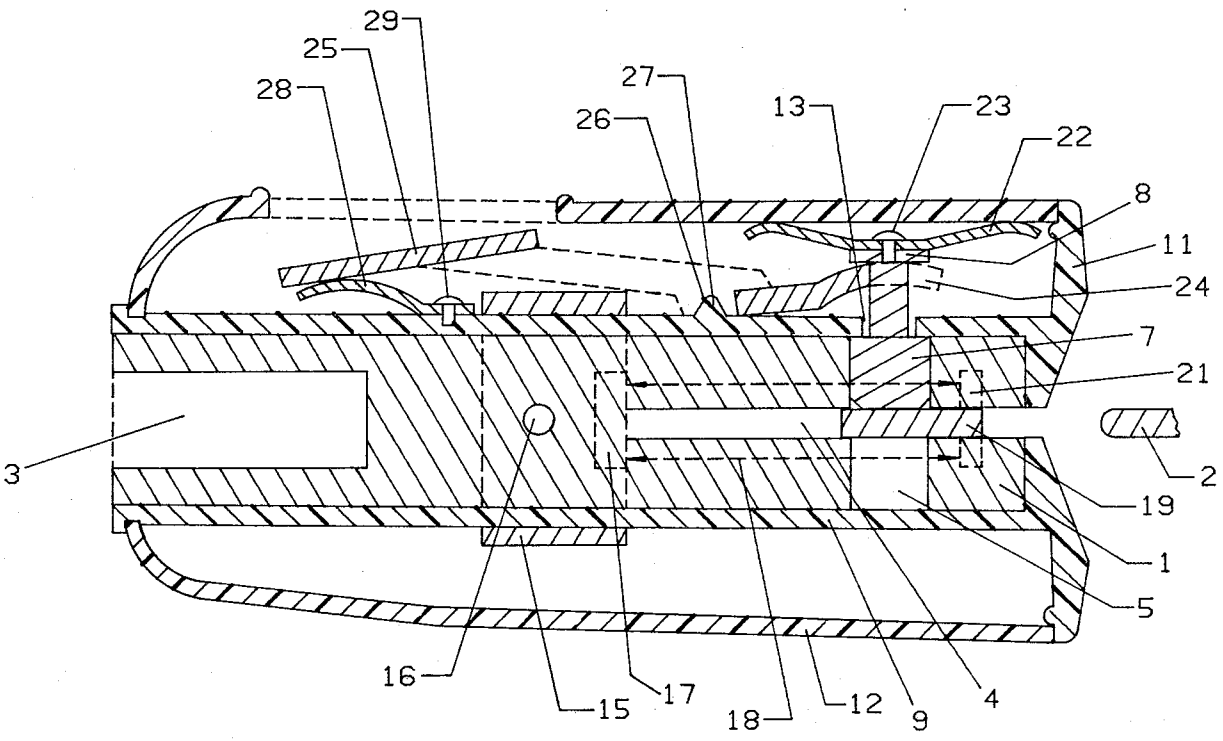
FIG. 3 is an enlarged cross section similar to that of FIG. 2 except that the push button has been depressed, ejecting the tongue. The ejector now supports the biased pin above the slot permitting the tongue to be reinserted.

The action of the buckle can better be understood by examining FIGS. 2 and 3. In FIG. 2, tongue 2 is inserted in the slot of the ferrule, and pin 2 extends through the opening in the tongue, locking it securely in place. The tongue ejector 19 has been forced back against its bias by the insertion of the tongue. The extended arms of the spring support 17 and of the ejector 21 are shown in phantom, and the arrows between them represent the compressed ejecting springs 18.

In FIG. 3, push button 25 has been depressed against the bias of flat spring 28 beneath it. Rocking back on fulcrum 26, the bifurcated end 24 of the push button member has raised pin 7 against the bias of flat spring 22 acting against the inner surface of the housing. The pin has been extracted from the opening in the tongue whereupon tongue ejector 19 has ejected tongue 2 as a result of the extension of the tongue ejector springs 18. The amount of this spring extension is indicated by the arrows between the arms of the spring support member 15 and the ejector 19.

When the pin 7 was released and the ejector shot forward, it came to rest over the cylindrical opening 5, thus when the push button was released, the ejector supported the pin, keeping it out of the slot and holding it in readiness for the next tongue insertion.

When the tongue is next inserted it forces back the tongue ejector 19 against the bias of springs 18, and as soon as the opening 6 in the tongue 2 comes in line with pin 7, it drops through the opening, biased thereto by flat spring 22, thus latching the tongue securely within the buckle.

The parts shown in FIG. 4 differ only slightly from those of FIGS. 1, 2 and 3. Bifurcated end 24 of the push button member slips beneath the head of cylindrical pin 7. The push button member has extended legs 31 journaled on projections 32 on opposite sides of the sheath. These projections can be shafts extending part way into the ferrule, or a single shaft passing through the ferrule to extend beyond the sides of the sheath on either side.

The upward bias of the push button and the downward bias of the pin are here supplied by a single trifurcated flat spring 33, the central tine of which supplies the downward bias to the pin. In FIG. 4, the bifurcated portion of the push button member and the flat trifurcated spring are repeated in inserts for clarity.

In FIG. 5, a sliding push button 34 is employed to extract pin 7 from the tongue. The pin is shown as cylindrical throughout its length. Near the top it has two openings or a single through opening to accommodate the ends of springs 35. These springs supply the downward bias to the pin. The other ends of these springs are fixed within the housing.

Wedges 36 are positioned on either side of the pin. At the foot of each wedge there is a raised ridge 42 which limits the outward movement of the sliding push button. When the sliding push button is pressed, the ends 35 of the springs are caused to ride up the advancing sloping surfaces of the wedges, raising the pin to which they are attached. As before, when the tongue is ejected, the tongue ejector comes to rest in the slot beneath the cylindrical opening, so that the pin is restrained above the slot until the tongue is again inserted.

An exploded view of the ferrule 1 including the tongue ejector 19 and the ejection spring 18 is shown. In this embodiment the slot is below the axis of the ferrule, and a concentric cylindrical opening 37 extends within the ferrule for the accommodation of a single coiled ejection spring 18. For that portion of the cylindrical opening common with the slot, the lower surface of the slot is substantially tangential with the cylindrical opening 37 as shown. A small protrusion 38 extending from the rear of the tongue ejector cooperates with the end of the ejector spring 18, while the arms 39 extending from the tongue ejector beyond the sides of the ferrule, contact the inner surface of the front face of the buckle when fully extended, thus providing a stop at the end of its forward travel at which point it is directly beneath the pin. The notches 41 in the extended arms permit a bit more rearward travel in that they provide space for that bit of spring 35 with which each side comes in contact.

Ridges 43 of the sliding push button slideably cooperate with corresponding grooves within the housing, and preferably spring bias is provided to maintain the sliding push button in its usual extended position. Such bias is optional, and is not shown.

The arrangement of this embodiment can be better understood by reference to FIG. 6, a half-section in elevation. Tongue 2 is shown inserted and latched into place, for pin 7 extends through the opening in the tongue. The pin is biased downwardly by springs 35. The tongue is restraining ejector 19 against the bias of spring 18. The wedges 36 are shown in phantom. The housing 12 differs from that of FIG. 1 through 4, being adapted for the use of sliding push button 34. It can be seen that pressure on the sliding push button containing wedges 36, will extract the pin from the tongue. When this occurs, tongue ejector 19 will eject the tongue and simultaneously position itself beneath the pin, holding it above the slot against its bias. It will remain there until displaced by an inserted tongue, then, when the opening in the tongue advances to a point beneath the biased pin, it will drop into latching engagement with the tongue.

While we have described preferred embodiments of our invention, it will be understood that various modifications can be made in the buckle and tongue combination described without departing from the spirit of this invention or the scope of the following claims.

We claim:

1. A seat buckle and tongue in combination comprising:

a ferrule having a passenger restraint fixed to one end, a through slot at the other for engaging the tongue, and an opening extending at least into the slot from the surface of the ferrule above the slot; a pin, positioned for motion within the opening and biased for engaging an opening in the tongue when said tongue is inserted into the slot; means for raising the pin in opposition to its bias to a position above the slot; and a tongue ejection member having a flat portion for longitudinal sliding action within the slot, said tongue ejection member being biased outwardly to the point in the slot directly beneath the pin.

2. The seat buckle and tongue of claim 1 wherein the ferrule is secured within a housing having an elongated opening at the front end for guiding the tongue into the slot of the ferrule, and opening at the rear for extending the passenger restraint, and a third opening to provide access to the means for raising the pin.

3. A seat buckle and tongue in combination comprising:

a. a buckle housing for a longitudinally disposed ferrule, said housing having at least three openings, including an elongated opening at the front end for the insertion of the tongue, and the other end for extending the passenger restraint;

b. said ferrule having a through slot at the front substantially in line with the elongated opening of the housing, said slot extending into the ferrule for a distance greater than the length of the forepart of the tongue to be inserted into the buckle, said slot providing parallel plane surfaces within the ferrule for slideably engaging the tongue;

c. an opening through the slotted portion of the ferrule substantially perpendicular to said plane surfaces, said opening extending from the surface of the ferrule at least into the slot;

d. the forepart of the tongue having an opening so positioned that when the tongue is inserted into the buckle to engage the slot of the ferrule, the opening in the tongue is aligned with the perpendicular opening through the slotted portion of the ferrule;

e. a pin extending slideably into the perpendicular opening of the ferrule and movable therein, from a first position above the slot to a second position wherein it extends at least to the lower surface provided by the slot, to latch the inserted tongue by passing through the opening in the tongue, said pin being biased in the direction of the second position;

f. a tongue ejecting member having a flat portion slideably positioned within the slot and biased toward the front of the buckle to a first position wherein said flat portion is beneath the pin when said pin is above the slot; said tongue ejecting member being moveable to a second position in opposition to its bias by the action of the inserted tongue, the leading edge of which contacts the slideable tongue ejector forcing it back as the tongue is advanced to its latching position;

g. means for extracting the pin from the latched tongue;

h. an opening in the housing to provide access to the means for extracting the pin; and i. means at the end of the ferrule for the fixed attachment of a passenger restraint.

4. The seat buckle of claim 3 wherein the means for raising the pin against its bias is a lever.

5. The seat buckle and tongue combination of claim 3 wherein the means for raising the pin against its bias is at least one wedge attached to a sliding push button.

6. The seat buckle and tongue combination of claim 4 wherein the lever comprises a push button at one end, a bifurcated portion engaging the head of the pin at the other, and a fulcrum, whereby downward pressure on the push button produces an upward movement of the bifurcation and engaged pin against its bias.

7. The seat buckle and tongue combination of claim 6 wherein the push button is biased upward by a spring, and the pin is biased downward by at least one spring.

8. The seat buckle and tongue combination of claim 7 wherein the push button is biased upward and the pin biased downward by a trifurcated flat metal spring attached to the lever between te fulcrum and the pin, with the central tine of the spring curving downward to apply biasing pressure to the top of the pin, and the remaining two tines curving upward to apply a downward pressure by acting against the housing.

9. The seat buckle and tongue combination of claim 5 wherein the ferrule is secured within a housing having an opening at the rear for the extending passenger restraint, an elongated opening in the forepart of the buckle for guiding the tongue into the slot of the ferrule, and above this, an opening for providing access to a sliding push button.

10. The seat buckle and tongue combination of claim 1 wherein the passenger restraint fixed to the end of the buckle is a rigid or semi rigid connector for attachment to the frame or body of a vehicle.

11. The seat buckle and tongue combination of claim 1 wherein the tongue has a second opening for the attachment of a passenger restraint.

12. The seat buckle and tongue combination of claim 11 wherein the passenger restraint is a flexible seat belt.

13. The seat buckle and tongue in combination of claim 5 wherein the pin has at its upper part, projections on opposite sides extending perpendicularly from the direction of the axis of the ferrule, said projections being in contact with the sloping surfaces of two wedges, one on each side of the pin, whereby pressure on a sliding push button to which the wedges are attached will raise the pin out of the slot against its bias.

14. The seat buckle and tongue combination of claim 13 wherein the sliding push button is biased outwardly, and there are upward extensions at the lower end of the wedges to engage the projections of the pin, thereby serving as stops to the outward movement of the sliding push button.

15. The seat buckle and tongue combination of claim 14 wherein the projections from the pin are springs which cooperate with the wedges and provide downward bias to the pin.

16. The seat buckle and tongue combination of claim 3 wherein the tongue ejector has arms which extend beyond the slot on each side of the ferrule, against which coil springs with the rear ends fixed, act to provide the bias to eject the tongue.

17. The seat belt and tongue combination of claim 3 wherein the tongue ejector is biased outwardly by a coil spring acting in back of the ejector in a cylindrical tunnel within the ferrule, said cylindrical tunnel extending all the way to the front of the ferrule for ease in assembly.

18. The seat buckle and tongue combination of claim 3 wherein the opening in the ferrule within which the pin slides, extends from the surface of the ferrule to the slot, and continues from the other side of the slot to the opposite surface of the ferrule.

* * * * *

UNITED STATES PATENT AND TRADEMARK OFFICE

CERTIFICATE OF CORRECTION

PATENT NO. : 4,000,548

DATED : January 4, 1977

INVENTOR(S) : Robert L. Stephenson and Jerome W. Schotthoefer

It is certified that error appears in the above-identified patent and that said Letters Patent are hereby corrected as shown below:

IN THE CLAIMS: Claim 8, line 4, "te" should be --the--.

Column 3, line 58 "cross-section" should be --cross section--.

Column 4, line 38, "port" should read --part--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*